US006693388B2

(12) United States Patent
Oomura

(10) Patent No.: US 6,693,388 B2
(45) Date of Patent: Feb. 17, 2004

(54) ACTIVE MATRIX DISPLAY

(75) Inventor: Masanobu Oomura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/199,075

(22) Filed: Jul. 22, 2002

(65) Prior Publication Data

US 2003/0020413 A1 Jan. 30, 2003

(30) Foreign Application Priority Data

Jul. 27, 2001 (JP) ..... 2001-226952

(51) Int. Cl.[7] ..... G09G 3/10

(52) U.S. Cl. ..... 315/169.3; 315/169.1; 345/76; 345/82

(58) Field of Search ..... 315/169.1, 169.3, 315/169.4, 224, 291; 345/76, 77, 82

(56) References Cited

U.S. PATENT DOCUMENTS

| | | | | |
|---|---|---|---|---|
| 5,684,365 A | | 11/1997 | Tang et al. | 315/169.3 |
| 6,356,029 B1 | * | 3/2002 | Hunter | 315/169.1 |
| 6,373,454 B1 | * | 4/2002 | Knapp et al. | 345/76 |
| 6,448,718 B1 | * | 9/2002 | Battersby | 315/169.3 |
| 6,542,138 B1 | * | 4/2003 | Shannon et al. | 345/76 |

FOREIGN PATENT DOCUMENTS

| | | | |
|---|---|---|---|
| EP | 0 102 234 | 3/1984 | G03B/15/00 |
| JP | 2001-56667 | 2/2001 | G09G/3/30 |
| JP | 2001-147659 | 5/2001 | G09G/3/20 |

* cited by examiner

*Primary Examiner*—Hoang Nguyen
(74) *Attorney, Agent, or Firm*—Fitzpatrick, Cella, Harper & Scinto

(57) ABSTRACT

An active matrix display is provided which eliminates variation of a threshold voltage of an active element inside a pixel and variation of a driving current due to the Early effect and supplies a desired driving current to a light emitting element of each pixel steadily and accurately. The active matrix display has a current-voltage converter arranged in series in a supply path through which a driving current is supplied to a light emitting element and has a voltage control current source that is controlled by an output voltage of the current-voltage converter, thereby generating a monitor current having correlation with the driving current at the time of setting the driving current, controlling a gate voltage of a driving current generating transistor based on the monitor current such that a desired luminance can be realized and holding the control voltage in a capacitor.

11 Claims, 10 Drawing Sheets

ACTIVE MATRIX DISPLAY

BACKGROUND OF THE INVENTION

1. Field of the Invention

The present invention relates to a display in which each pixel is provided with a light emitting element, the luminance of which is controlled by a current such as an organic electroluminescent (EL) element. More specifically, the present invention relates to an active matrix display for supplying a current to a light emitting element by an active element such as an insulated-gate field-effect transistor provided inside each pixel.

2. Related Background Art

In recent years, displays using an organic EL element have been developed. As a method of driving the element, there are a simple matrix system and an active matrix system. Since the former is simple in its structure but has difficulty in realizing a large and high definition display, many active matrix type displays have been developed.

If a large number of organic EL elements are used and driven by an active matrix circuit, an insulted-gate field-effect transistor, a so-called thin film transistor (hereinafter referred to as TFT), for controlling supply of a driving current for driving a light emitting element, is connected to each pixel. A light emitting operation of the organic EL element is controlled by controlling this TFT.

Background Example 1

FIG. 9 shows an equivalent circuit for one pixel disclosed in U.S. Pat. No. 5,684,365.

A pixel circuit provided in a pixel is constructed by an organic EL element OLED, a thin film transistor (TFT) 1, a thin film transistor (TFT) 2 and a capacitor C. Since an organic EL element generally has a rectification characteristic, it is sometimes called an organic light emitting diode (OLED). In the figure, a symbol of a diode is used. However, a light emitting element is not always limited to the OLED, but also may be any light emitting element as long as its luminance is controlled by a current flowing to the element. In addition, the rectification characteristic is not always required. In FIG. 9, a source and a drain of the p-type TFT 2 are connected to a power supply potential Vdd and an anode of the organic EL element OLED, respectively, and a cathode of the organic EL element OLED is connected to a ground potential. On the other hand, a gate, a source and a drain of the p-type TFT 1 are connected to a scanning line Scan, a data line Data, and one end of the capacitor C, and a gate of the TFT 2, respectively, and the other end of the capacitor C is connected to the power supply potential Vdd.

First, when the TFT 1 is turned ON by the scanning line Scan to apply a data potential Vw representing luminance information to the data line Data in order to operate the pixel, the capacitor C is charged or discharged, whereby a gate potential of the TFT 2 becomes equal to the data potential Vw. When the TFT 1 is turned OFF by the scanning line Scan, the gate potential of the TFT 2 is held by the capacitor C, and a driving current corresponding to a gate to source voltage Vgs of the TFT 2 is supplied to the organic EL element OLED. Thus, the organic EL element OLED continues to emit light at a luminance corresponding to an amount of the current.

Background Example 2

FIG. 10 shows an equivalent circuit for one pixel disclosed in JP 2001-56667 A.

A pixel circuit provided in a pixel is constructed by an organic EL element OLED, a TFT 1 for converting a signal current to a voltage or supplying a current to the organic EL element OLED, a TFT 2 for controlling an operating state of the TFT 1, a TFT 3 and a TFT 4 for selecting a state in which a signal current is taken in or a state in which a driving current is supplied to the organic EL element OLED, and a capacitor C for holding a voltage.

In FIG. 10, a source and a gate of the TFT 1 are connected to a power supply potential Vdd, and a source of the TFT 2 and one end of the capacitor C, respectively. The other end of the capacitor C is connected to the power supply potential Vdd. A drain of the TFT 1 is connected to a drain of the TFT 2, a drain of the TFT 3 and a drain of the TFT 4. A source of the TFT 4 is connected to an anode of the organic EL element OLED, and a cathode of the organic EL element OLED is connected to a ground potential. A source of the TFT 3 is connected to a data signal line Data, and all gates of the TFT 2, TFT 3 and TFT 4 are connected to a scanning line Scan.

First, when the TFT 2 and the TFT 3 are turned ON and the TFT 4 is turned OFF by the scanning line Scan in order to operate the pixel, a signal current Iw is taken in the TFT 1, a gate to source voltage Vgs required for flowing the signal current Iw is generated in the TFT 1, and the voltage Vgs is held in the capacitor C. When the TFT 2 and the TFT 3 are turned OFF and the TFT 4 is turned ON by the scanning line Scan, the TFT 1 continues to flow a driving current to the organic EL element OLED based on the voltage held in the capacitor C. Thus, the organic EL element OLED continues to emit light at a luminance corresponding to an amount of the current.

Background Example 3

FIG. 11 shows an equivalent circuit for one pixel disclosed in JP 2001-147659 A (EP A2 1102234).

A pixel circuit provided in a pixel is constructed by a TFT 1 for converting a signal current to a voltage, a TFT 2 for controlling a driving current flowing to a light emitting element, a TFT 3 for taking in a current which connects or disconnects the pixel circuit and a data line by a scanning line ScanA, a transistor for switching TFT 4 that shorts between a gate and a drain of the TFT 1 while luminance information is written by a scanning line ScanB, a capacitor C for holding a gate to a source voltage of the TFT 1 even after the luminance information is written, and an organic EL element OLED.

In FIG. 11, sources of the TFT 1 and the TFT 2 are connected to a power supply potential Vdd, and a gate of the TFT 1 is connected to a gate of the TFT 2, one end of the capacitor C and a drain of the TFT 4. The other end of the capacitor C is connected to the power supply potential Vdd. A drain of the TFT 2 is connected to an anode of an organic EL element OLED, and a cathode of the organic EL element OLED is connected to a ground potential. A drain of the TFT 1 is connected to a source of the TFT 4 and a drain of the TFT 3. A source of the TFT 3 is connected to a data signal line Data. A gate of the TFT 3 is connected to a scanning line ScanA, and a gate of the TFT 4 is connected to a scanning line ScanB.

First, when the TFT 3 and the TFT 4 are turned ON by the scanning lines ScanA and ScanB in order to operate the pixel, the TFT 1 and the TFT 2 come to have a current mirror structure. A signal current Iw is taken in the TFT 1, the TFT 2 flows a current to the organic EL element OLED in accordance with a current mirror ratio, and a voltage generated in the gate of the TFT 1 is held in the capacitor C. When the TFT 3 and the TFT 4 are turned OFF by the scanning lines ScanA and ScanB, the current mirror structure of the TFT 1 and the TFT 2 is released. The TFT 2 continues flowing a current to the organic EL element OLED in accordance with the voltage held in the capacitor C. The light emitting element continues to emit light at a luminance corresponding to an amount of the current.

In an active matrix display, thin film transistors functioning as active elements are generally formed on a single glass substrate simultaneously using amorphous silicon or polysilicon. However, the TFTs that are formed using amorphous silicon or polysilicon are known to have large variation of their characteristics, because the TFTs have worse crystallinity and worse controllability of a transmission mechanism compared with monocrystal (single crystal) silicon.

Therefore, it is not rare that, even in the TFTs formed on the same substrate, their threshold voltages Vth vary by several hundred mV or, in some cases, 1V or more for each pixel. In this case, for example, since the Vth varies depending on a pixel even if the same signal potential Vw is written in different pixels, a current flowing to a light emitting element changes, and a desired luminance cannot be obtained. Therefore, a high image quality cannot be expected as a display.

The structure of Background Example 1 (U.S. Pat. No. 5,684,365) is directly affected by this problem. In addition, Background Example 2 (JP 2001-56667 A) solves the problem of threshold voltage variation. However, since a source/drain voltage Vds of the TFT 1 at the time when a signal current is converted into a voltage and a source/drain voltage Vds of the TFT 1 at the time when a driving current is supplied to the organic EL element OLED are different, a correct driving current based on a data signal cannot be flowed to the light emitting element due to the Early effect of a transistor. In addition, the Background Example 3 (JP 2001-147659 A) changes variation of threshold voltages to error levels of the current mirror constructed by the TFT 1 and the TFT 2, thereby reducing the variation. However, it does not fundamentally solve the problem. Further, since a source/drain voltage Vds1 of the TFT 1 is different from a source/drain voltage Vds of the TFT 2, an accurate driving current cannot be flowed to the light emitting element due to the Early effect of a transistor as in Background Example 2. Moreover, if an operating voltage of the organic EL element OLED increases and the source/drain voltage of the TFT 1 cannot be secured sufficiently with the result that the transistor operates in a triode region, a current deviating largely from a desired driving current is supplied to the light emitting element.

SUMMARY OF THE INVENTION

The present invention has been devised in view of the above-mentioned drawbacks, and it is an object of the present invention to provide an active matrix display that solves the problem associated with variation of driving current to be supplied to a light emitting element, which is attributable to variation of a threshold voltage present in the above-mentioned conventional techniques and that is higher in performance than conventional displays.

Therefore, according to the present invention, there is provided an active matrix display in which a plurality of pixels provided with a pixel circuit containing at least a light emitting element are arranged in a matrix shape and which has at least a scanning side drive circuit and a data side drive circuit for performing control of the pixel circuit, wherein the light emitting element is a light emitting element of a current control type, the luminance of which changes according to a driving current flowing to the light emitting element, wherein the pixel circuit comprises at least the light emitting element, a first voltage control current source, a first switch circuit, a driving current-voltage converter, a second voltage control current source and a second switch circuit, the first voltage control current source comprising at least an active element controlled by a control voltage and a memory circuit capable of storing the control voltage and having a function of generating the driving current based on the control voltage, the first switch circuit having a function of switching the first voltage control current source to a voltage controllable state and a control voltage holding state, the driving current-voltage converter being serially connected to a current path through which the driving current flows and having a function of converting the driving current into a voltage, the second voltage control current source having a function of generating a monitor current correlating with the driving current based on an output voltage of the driving current-voltage converter, and the second switch circuit having a function of switching the second voltage control current source to an output state and a non-output state, wherein the scanning side drive circuit is at least connected to the first switch circuit and the second switch circuit and has a function of performing control for switching the first voltage control current source to the voltage controllable state or the control voltage holding state and control for switching the second voltage control current source to the output state or the non-output state, and wherein the data side drive circuit is at least connected to the first voltage control current source via the first switch circuit and connected to the second voltage control current source via the second switch circuit and has a function of controlling a control voltage of the first voltage control current source based on the monitor current correlating with the driving current such that a current value of the driving current becomes a desired current value corresponding to luminance information when the first voltage control current source is in the voltage controllable state and the second voltage control current source is in the output state.

Further, a voltage control current source indicates means for regulating a current that is flowed based on a voltage, a driving current-voltage converter indicates means for outputting a voltage correlating with a driving current, a monitor current-voltage converter indicates means for outputting a voltage correlating with a monitor current, a voltage comparator indicates means for not only comparing voltages but also for outputting a voltage based on the comparison.

In addition, a voltage controllable state indicates a state in which it is possible to change and control a control voltage, a control voltage holding state indicates a state in which a control voltage recorded in a storage circuit is not allowed to be changed from the outside, an output state indicates a state in which a monitor current is allowed to flow, and a non-output state indicates a state in which a monitor current is not allowed to flow.

Other objects and features of the present invention will become apparent from the following detailed description and accompanying drawings, in which like reference characters designate the same or similar parts throughout the figures thereof.

DESCRIPTION OF THE PREFERRED EMBODIMENTS

Preferred embodiments of the present invention using an organic electroluminescent element (organic EL element) as a light emitting element will be hereinafter described. However, the present invention is not limited to these embodiments and has an effect in an active matrix display using a current-controlled light emitting element, the luminance of which is controlled by a driving current flowing to the light emitting element.

First Embodiment

Figure 1:
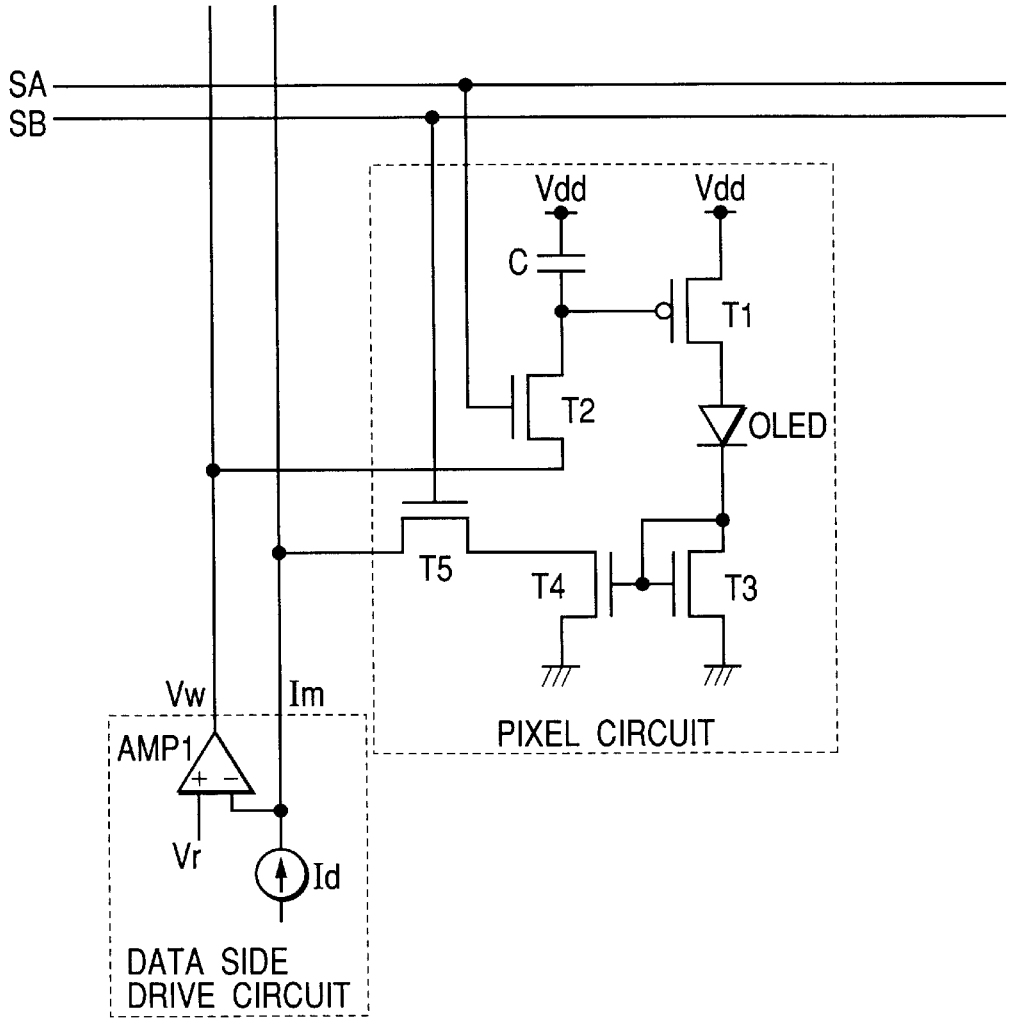
FIG. 1 is a diagram showing a first embodiment of an active matrix display of the present invention.

FIG. 1 is a diagram showing a first embodiment of an active matrix display of the present invention. In FIG. 1, a pixel circuit is shown only for one pixel.

First, a structure of the active matrix display will be described.

The pixel circuit inside the pixel is constructed by an organic EL element OLED, a p-type thin film transistor T1 forming a first voltage control current source, a capacitor C for recording and holding a control voltage of the first voltage control current source, an n-type thin film transistor T2 functioning as a first switch circuit for controlling a control voltage of the first voltage control current source to be in a voltage controllable state or a control voltage holding state, an n-type thin film transistor T3 functioning as a driving current-voltage converter for converting a driving current generated in the first voltage control current source into a voltage, an n-type thin film transistor T4 functioning as a second voltage control current source that is controlled by an output voltage of the driving current-voltage converter, and an n-type thin film transistor T5 functioning as a second switch circuit for controlling a monitor current generated by the second voltage control current source to be in an output state or a non-output state. In the structure shown in this embodiment, the driving current-voltage converter of the T3 and the second voltage control current source of the T4 are formed in a current mirror structure.

A data side drive circuit is provided outside a pixel region. In the inside of the data side drive circuit, a voltage comparator AMP1 having a voltage of a reference voltage source Vr as one input and a reference current source Id having luminance information are arranged.

The structure of the active matrix display will be described in more detail.

One end of the capacitor C and a drain of the n-type thin film transistor T2 are connected to a gate of the p-type thin film transistor T1 (The electrode (which is used as the drain here) of the T2 also functions as a source in charging or discharging the capacitor C. However, for simplicity of explanation, among two electrodes of the T2 to be the source or the drain of the thin film transistor, the one connected to the capacitor C is referred to as the drain in this specification). A source of the T1 and the other end of the capacitor C are connected to a power supply potential Vdd. A drain of the T1 is connected to an anode of the organic EL element OLED. A gate and a drain of the n-type thin film transistor T3 and a gate of the n-type thin film transistor T4 are connected to a cathode of the OLED. Sources of the T3 and the T4 are connected to a ground potential. A drain of the T4 is connected to a source of the n-type thin film transistor T5. A drain of the T5 is connected to an output end of the reference current source Id having luminance information, which is arranged inside the data side drive circuit provided outside the pixel region, and a negative electrode terminal of the voltage comparator AMP1. A voltage from the reference voltage source Vr is inputted in a positive electrode terminal of the AMP1, and an output of the AMP1 is connected to the source of the T2 inside the pixel. A scanning line is connected to the gate of the T2, and a scanning signal SA from a scanning side drive circuit (not shown) provided outside the pixel region is inputted therein. In addition, another scanning line is connected to a gate of the T5, and a scanning signal SB is inputted therein.

Next, operations will be described.

First, in order to cause a pixel to emit light at a desired luminance, a gate voltage (control voltage) of the T1 is set which determines a driving current that should be supplied to the OLED. In order to perform this operation, first, a scanning signal SB is set at a high level to turn ON the T5 (make the T5 conductive) and, then, a scanning signal SA is set at the high level to turn ON the T2 (make the T2 conductive). Consequently, the first voltage control current source comes to be in the voltage controllable state and the second voltage control current source comes to be in the output state. The time when the voltage control current sources are in this state is hereinafter referred to as a control time of a control voltage. At this control time, the T1 generates a driving current in accordance with a gate voltage and supplies the current to the OLED. The driving current flowing through the OLED is once converted into a voltage signal by the driving current-voltage converter of the T3. The second voltage control current source of the T4 generates a current (monitor current) Im correlating with the driving current in response to the voltage signal. The monitor current Im is added to the reference current source Id in the data side drive circuit provided outside the pixel region and charges or discharges a capacity (not shown) parasitic on the negative electrode terminal of the AMP1, thereby controlling the gate voltage of the T1 via the T2 such that the gate voltage becomes equal to a voltage of the reference voltage source Vr inputted in the positive electrode terminal of the AMP1. Then, when the monitor current Im correlating with the driving current generated by the T1 and a current of the reference current source Id having luminance information become equal, the control comes to be in a stable state and the control voltage is set appropriately. The gate voltage (control voltage) of the T1 controlled in this way is held in the capacitor C.

When the control voltage is set, the scanning signal SA is set at a low level to turn OFF the T2 (make the T2 nonconductive) and, then, the scanning signal B is set at the low level to turn OFF the T5 (make the T5 nonconductive). Consequently, the first voltage control current source comes to be in the control voltage holding state, and the second voltage control current source comes to be in the non-output state. This state is hereinafter referred to as a holding time of a control voltage. At this holding time, control from the data side drive circuit outside the pixel region is not performed, and the control voltage recorded in the capacitor C inside the pixel is held. The driving current continues to be supplied to the organic EL element OLED from the T1 by the held voltage.

Note that it is desirable to change the scanning signals SA and SB in the above-described order rather than simultaneously in order to accurately write the control voltage in the capacitor.

In this embodiment, since the driving current is controlled to have a desired current value by the data side drive circuit provided outside the pixel region, the problem, wherein the threshold voltage of the transistor determining the driving current of each pixel varies thereby changing a luminance for each pixel, does not occur.

In addition, since there is no change in a route on which the driving current flows at the control time and the holding time of the control voltage, the driving current is not affected by the Early effect of the transistor generating the driving current.

Moreover, even if an anode/cathode end voltage (ON voltage) at the time of a light emitting operation of the organic EL element OLED changes significantly according to a luminance or the ON voltage rises significantly by deterioration over time, whereby the source/drain voltage of the transistor T1 generating the driving current cannot be secured sufficiently and the transistor T1 comes to be in an operating state in a triode region (linear region), the driving current can be supplied to the organic EL element OLED accurately.

In addition, if the monitor current is small compared with a parasitic capacitance of wiring and control cannot be performed steadily, it is sufficient to appropriately design a mirror ratio of the current mirrors of the T3 and T4.

In addition, other than the structure shown in this embodiment, a structure in which the p-type transistor is changed to an n-type transistor and the n-type transistor is changed to a p-type transistor may be employed. However, such a structure will not be described because it can be easily inferred.

Further, although this embodiment is described with reference to the insulated-gate thin film transistor using amorphous silicon or polysilicon as a transistor, the present invention is not always limited to using a transistor formed of a silicon material. A type of a transistor used in the present invention is not limited as long as the same effect can be realized by a transistor formed of a compound semiconductor, an organic semiconductor or the like.

Second Embodiment

Figure 4:
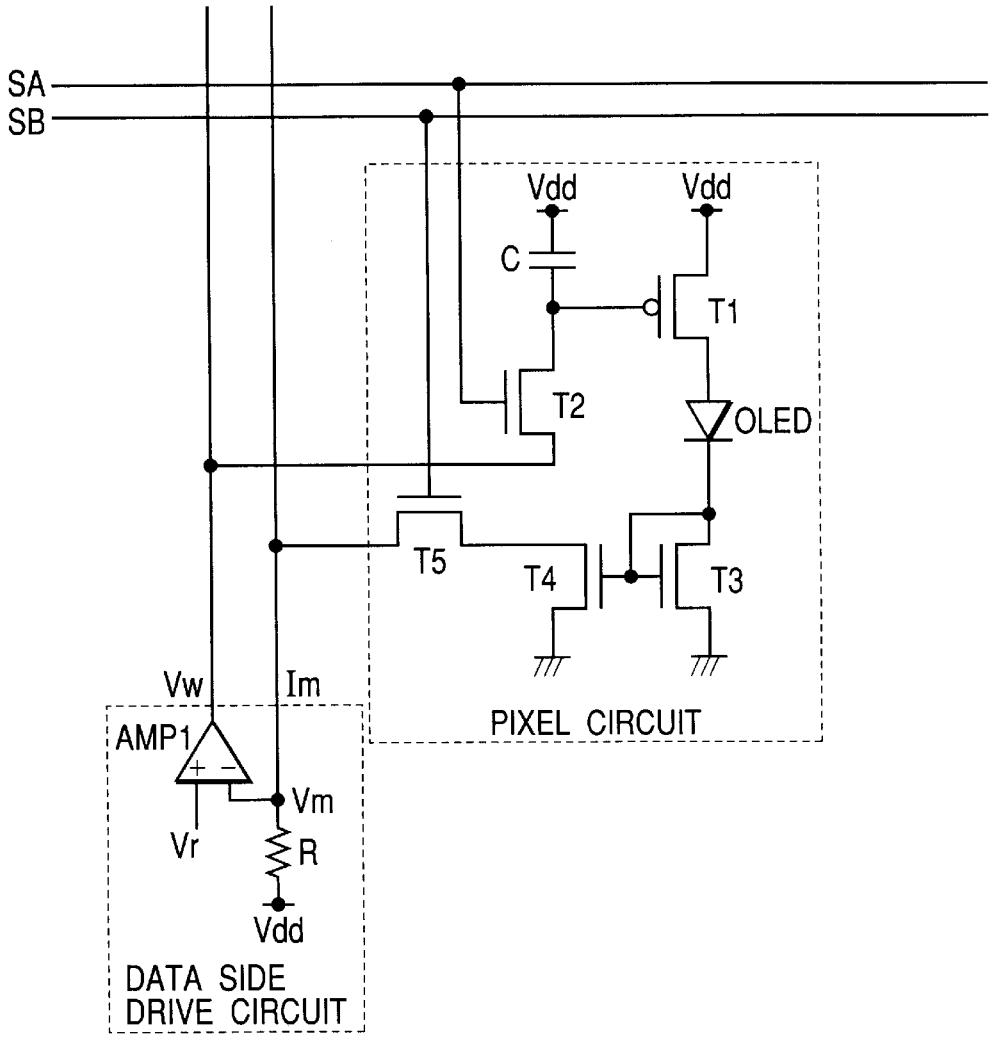
FIG. 4 is a diagram showing a second embodiment of the active matrix display of the present invention.

FIG. 4 is a diagram showing a second embodiment of the active matrix display of the present invention. In FIG. 4, a pixel circuit is shown only for one pixel.

First, a structure of the active matrix display will be described. The structure of the pixel circuit will not be described because it is the same as that of the first embodiment.

A data side drive circuit is provided outside a pixel region. In the data side drive circuit, there are arranged the voltage comparator AMP1 with a voltage of the reference voltage source Vr having luminance information as one input and a resistor R functioning as a monitor current-voltage converter. An output of the AMP1 is connected to the gate of the transistor T1 via the T2 functioning as a first switch circuit. A voltage of the reference voltage source Vr is inputted in the positive electrode terminal of the AMP1. The T4 functioning as a second voltage control current source and the power supply potential Vdd are connected to the negative electrode terminal of the AMP1 via the T5 functioning as a second switch circuit and via the resistor R functioning as the monitor current-voltage converter, respectively.

Next, parts characteristic of this embodiment among operations for setting and controlling a driving current will be described.

At the control time of a control voltage, the monitor current Im correlating with the driving current is inputted in the data side drive circuit. The monitor current Im is converted into a voltage Vm by the resistor R. The voltage Vm is inputted in the negative electrode terminal of the AMP1, controls the gate voltage (control voltage) of the transistor T1 via the T2 functioning as the first switch circuit such that the gate voltage becomes equal to the voltage of the reference voltage source Vr inputted in the positive electrode terminal of the AMP1, and generates a driving current for realizing a desired luminance to supply it to a light emitting element.

The holding time of the control voltage will not be described because it is the same as that in the first embodiment.

In this embodiment, the same effect as in the first embodiment is obtained.

Further, although the luminance information is given to the voltage of the reference voltage source Vr in the above description, the present invention is not limited to this. A resistance value of the resistor R may be changed according to luminance information with the voltage of the reference voltage source Vr fixed.

Third Embodiment

Figure 5:
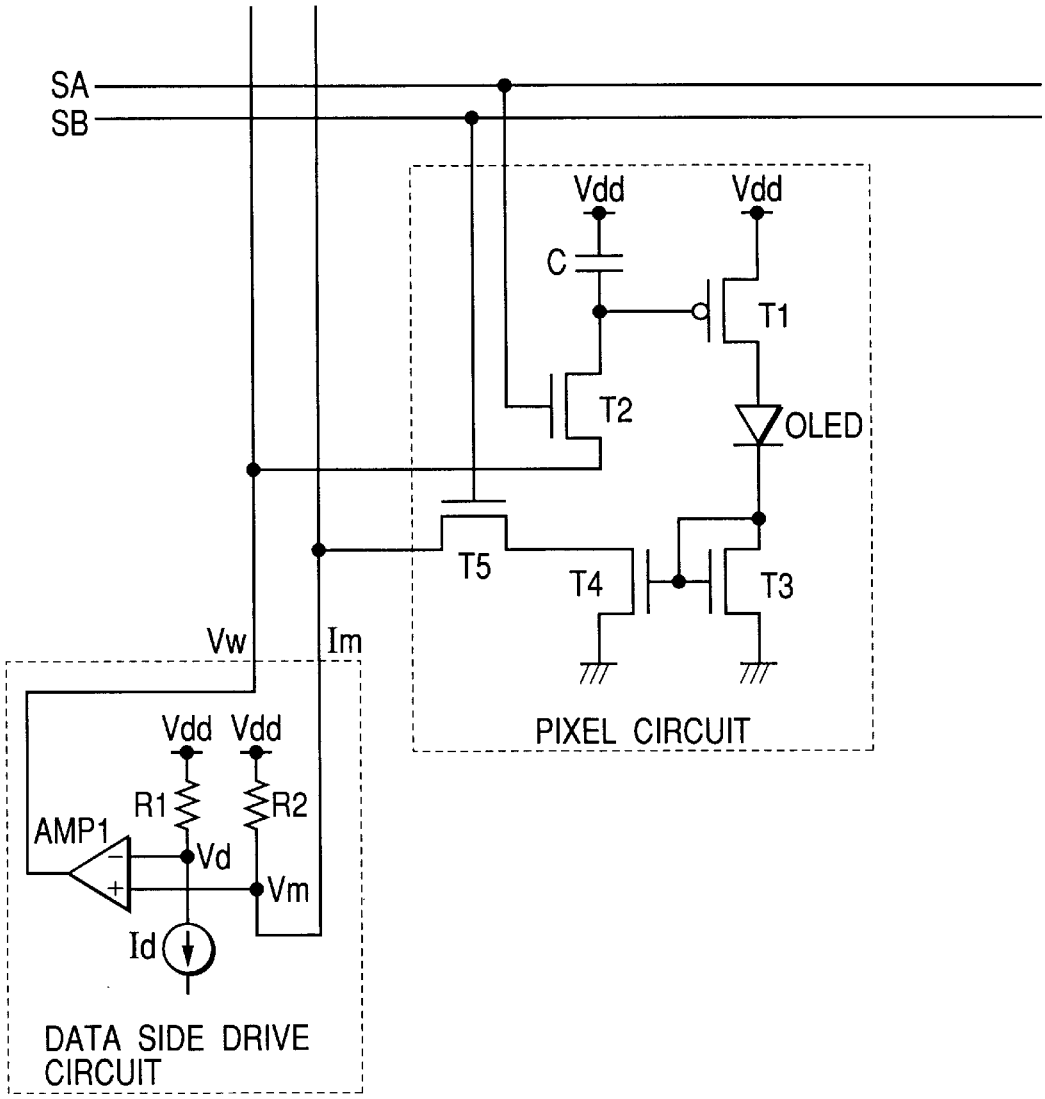
FIG. 5 is a diagram showing a third embodiment of the active matrix display of the present invention.

FIG. 5 is a diagram showing a third embodiment of the active matrix display of the present invention. In FIG. 5, a pixel circuit is shown only for one pixel.

First, a structure of the active matrix display will be described. The inside structure of the pixel will not be described because it is the same as that of the first embodiment.

A data side drive circuit is provided outside a pixel region. In the data side drive circuit, the reference current source Id having luminance information is connected to one end of a resistor R1 and is also connected to the negative electrode terminal of the voltage comparator AMP1. In addition, the monitor current Im correlating with a driving current is inputted in one end of a resistor R2 functioning as a monitor current-voltage converter and is also inputted in the positive electrode terminal of the voltage comparator AMP1. Further, the other ends of the R1 and R2 are connected to the power supply voltage Vdd. The output of the AMP1 is connected to the gate of the transistor T1 via the T2 functioning as the first switch circuit.

Next, parts characteristic of this embodiment among operations for setting and controlling a driving current will be described.

At the control time of a control voltage, the monitor current Im correlating with a driving current is inputted in the data side drive circuit. The voltage Vm, which is converted from the current Im by the resistor R2, controls the gate voltage (control voltage) of the transistor T1 via the T2 functioning as the first switch circuit such that the gate voltage becomes equal to the voltage Vd generated in the reference current source Id and the resistor R1, and generates a driving current for realizing a desired luminance to supply it to a light emitting element.

The holding time of the control voltage will not be described because it is the same as that in the first embodiment.

In this embodiment, the same effect as in the first embodiment is obtained.

Fourth Embodiment

Figure 6:
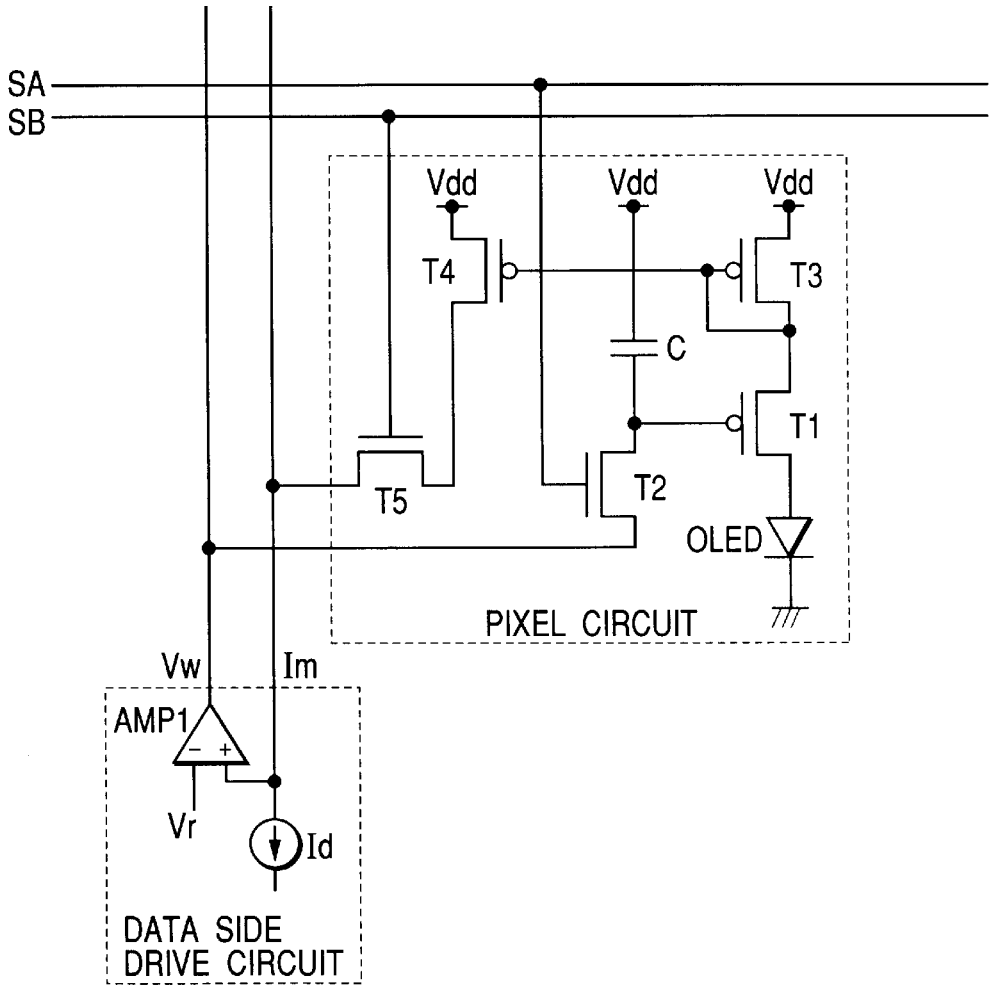
FIG. 6 is a diagram showing a fourth embodiment of the active matrix display of the present invention.

FIG. 6 is a diagram showing a fourth embodiment of the active matrix display of the present invention. In FIG. 6, a pixel circuit is shown only for one pixel.

A structure of the active matrix display will be described.

The inside of the pixel is constructed by an organic EL element OLED, a p-type thin film transistor T1 forming a first voltage control current source, a capacitor C for recording and holding a control voltage of the first voltage control current source, an n-type thin film transistor T2 functioning as a first switch circuit for controlling a control voltage of the first voltage control current source to be in a voltage controllable state or a control voltage holding state, a p-type thin film transistor T3 functioning as a driving current-voltage converter for converting a driving current generated in the first voltage control current source into a voltage, a p-type thin film transistor T4 functioning as a second voltage control current source that is controlled by an output voltage of the driving current-voltage converter, and an n-type thin film transistor T5 functioning as a second switch circuit for controlling a monitor current generated by the second voltage control current source to be in an output state or a non-output state. In the structure shown in this embodiment, the driving current-voltage converter of the T3 and the second voltage control current source of the T4 are formed in a current mirror structure.

A data side drive circuit is provided outside a pixel region. Inside the data side drive circuit, a voltage comparator AMP1 having a voltage of a reference voltage source Vr as one input and a reference current source Id having luminance information are arranged.

The structure of the active matrix display will be described more in detail.

One end of the capacitor C and a drain of the n-type thin film transistor T2 are connected to a gate of the p-type thin film transistor T1. The other end of the capacitor C is connected to the power supply voltage Vdd. A drain of the T1 is connected to an anode of the organic EL element OLED, and a cathode of the organic EL element OLED is connected to a ground potential. A gate and a drain of the p-type thin film transistor T3 and a gate of the p-type thin film transistor T4 are connected to a source of the T1. Sources of the T3 and the T4 are connected to the power supply potential Vdd. A drain of the T4 is connected to a drain of the n-type thin film transistor T5. A source of the T5 is connected to an output end of the reference current source Id having luminance information in the data side drive circuit provided outside the pixel region and to a positive electrode terminal of the voltage comparator AMP1. A voltage of the reference voltage source Vr is inputted in a negative electrode terminal of the AMP1, and an output of the AMP1 is connected to a source of the T2 inside the pixel. A scanning line is connected to a gate of the T2, and the scanning signal SA from the scanning side drive circuit (not shown) provided outside the pixel region is inputted therein. In addition, another scanning line is connected to a gate of the T5, and the scanning signal SB is inputted therein.

Next, operations will be described.

First, in order to cause a pixel to emit light at a desired luminance, a gate voltage of the T1 is set which determines a driving current that should be supplied to the OLED. In order to perform this operation, first, a scanning signal SB is set at a high level to turn ON the T5 (make the T5 conductive) and, then, a scanning signal SA is set at the high level to turn ON the T2 (make the T2 conductive). At this control time of the control voltage, the T1 generates a driving current in accordance with a gate voltage and supplies the current to the OLED. At this point, since the driving current generated by the T1 flows via the driving current-voltage converter of the T3, the driving current-voltage converter creates a voltage corresponding to the driving current. The second voltage control current source of the T4 generates the current (monitor current) Im correlating with the driving current. In this embodiment, the T3 and the T4 perform a current mirror operation. The monitor current Im is added to the reference current source Id in the data side drive circuit provided outside the pixel region and charges or discharges a capacity (not shown) parasitic on the positive electrode terminal of the AMP1, thereby controlling the gate voltage of the T1 such that the gate voltage becomes equal to a voltage of the reference voltage source Vr inputted in the negative electrode terminal of the AMP1. Then, when the monitor current Im correlating with the driving current generated by the T1 and a current of the reference current source Id having luminance information become equal, the control comes to be in a stable state and the control voltage is set appropriately. The gate voltage (control voltage) of the T1 controlled in this way is held in the capacitor C.

When the control voltage is set, the scanning signal SA is set at a low level to turn OFF the T2 (make the T2 non-conductive) and, then, the scanning signal SB is set at the low level to turn OFF the T5 (make the T5 non-conductive). At this holding time of the control voltage, control from the data side drive circuit outside the pixel region is not performed, and the control voltage recorded in the capacitor C inside the pixel is held. The driving current continues to be supplied to the OLED from the T1 by this held voltage.

Note that it is desirable to change the scanning signals SA and SB in the above-described order rather than simultaneously in order to accurately write the control voltage in the capacitor.

In this embodiment, the same effect as in the first embodiment is realized and, since one end of the OLED is connected to a potential common to all the pixels, manufacture of a display is simplified.

Fifth Embodiment

Figure 7:
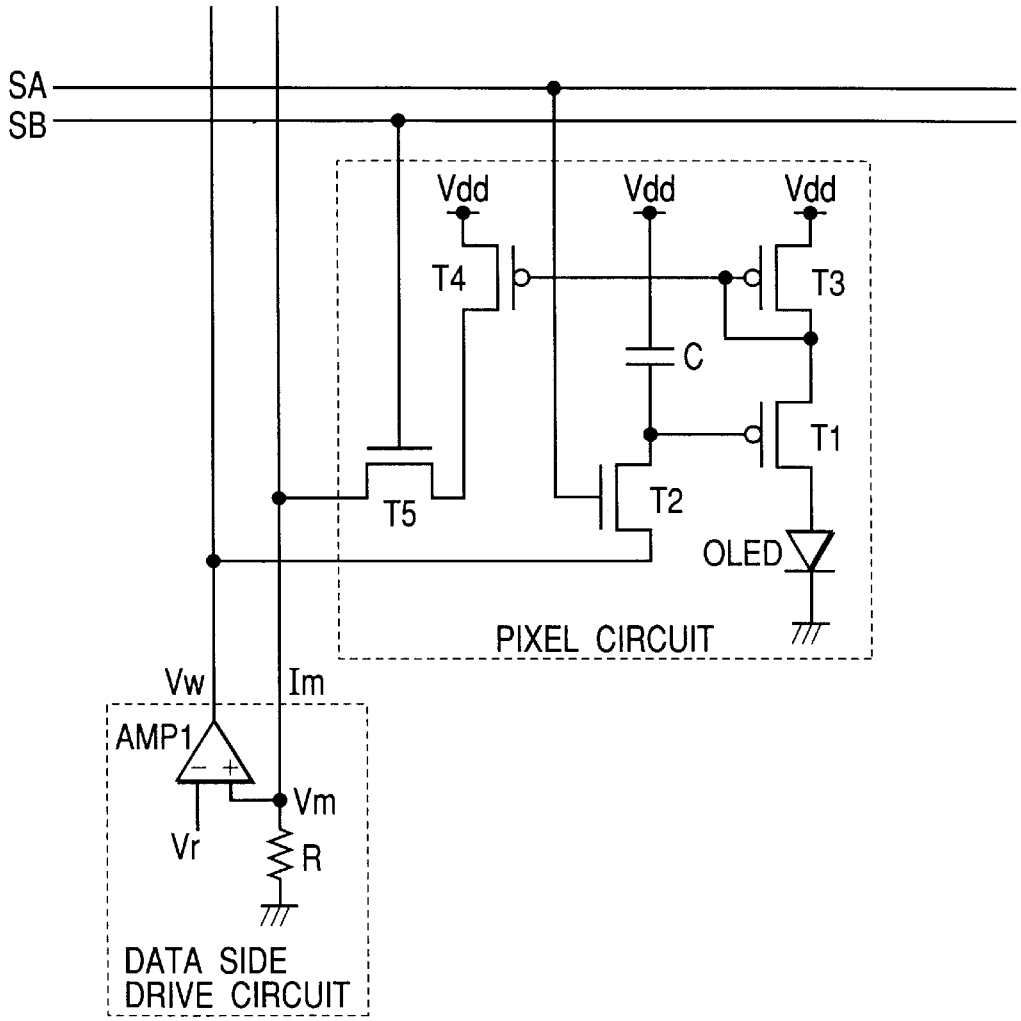
FIG. 7 is a diagram showing a fifth embodiment of the active matrix display of the present invention.

FIG. 7 is a diagram showing a fifth embodiment of the active matrix display of the present invention. In FIG. 7, a pixel circuit is shown only for one pixel.

First, a structure of the active matrix display will be described. The structure of the pixel circuit will not be described because it is the same as that of the fourth embodiment.

A data side drive circuit is provided outside a pixel region. In the data side drive circuit, there are arranged the voltage comparator AMP1 with a voltage of the reference voltage source Vr having luminance information as one input and a resistor R functioning as a monitor current-voltage converter. An output of the AMP1 is connected to the gate of the transistor T1 via the T2 functioning as a first switch circuit. A voltage of the reference voltage source Vr is inputted in the negative electrode terminal of the AMP1. The T4 functioning as a second voltage control current source and the ground potential are connected to the positive electrode terminal of the AMP1 via the T5 functioning as a second switch circuit and via the resistor R functioning as the monitor current-voltage converter, respectively.

Next, parts characteristic of this embodiment among operations for setting and controlling a driving current will be described.

At the control time of a control voltage, the current (monitor current) Im correlating with the driving current is inputted in the data side drive circuit. The monitor current Im is converted into a voltage Vm by the resistor R. The voltage Vm is inputted in the positive electrode terminal of the AMP1, controls the gate voltage (control voltage) of the transistor T1 via the T2 functioning as the first switch circuit such that the gate voltage becomes equal to the voltage of the reference voltage source Vr inputted in the negative electrode terminal of the AMP1, and generates a driving current for realizing a desired luminance to supply it to a light emitting element.

The holding time of the control voltage will not be described because it is the same as that in the fourth embodiment.

In this embodiment, the same effect as in the fourth embodiment is obtained.

Further, although the luminance information is given to the voltage of the reference voltage source Vr in the above description, the present invention is not limited to this. A resistance value of the resistor R may be changed according to the luminance information with the voltage of the reference voltage source Vr fixed.

Sixth Embodiment

Figure 8:
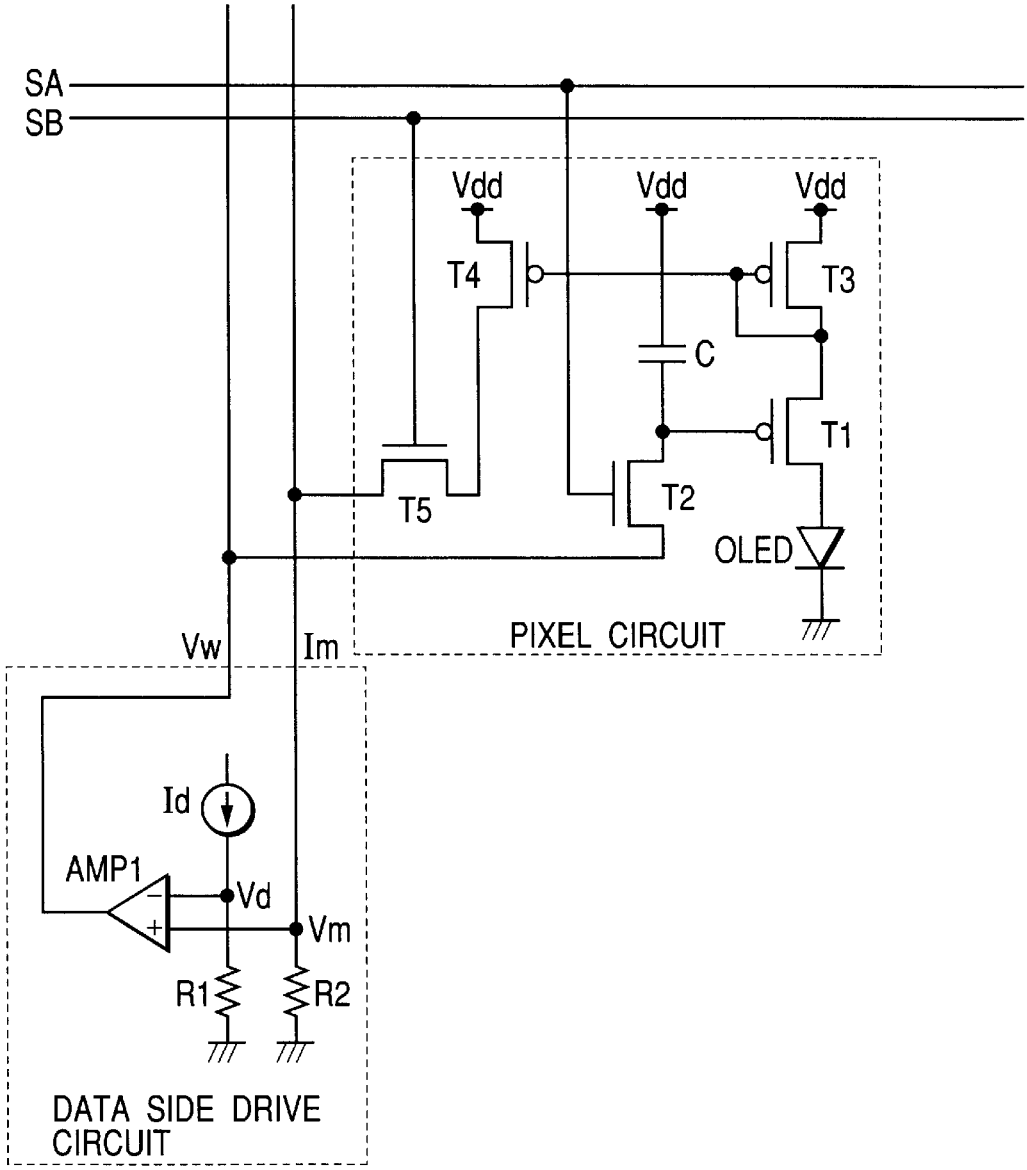
FIG. 8 is a diagram showing a sixth embodiment of the active matrix display of the present invention.
Figure 9:
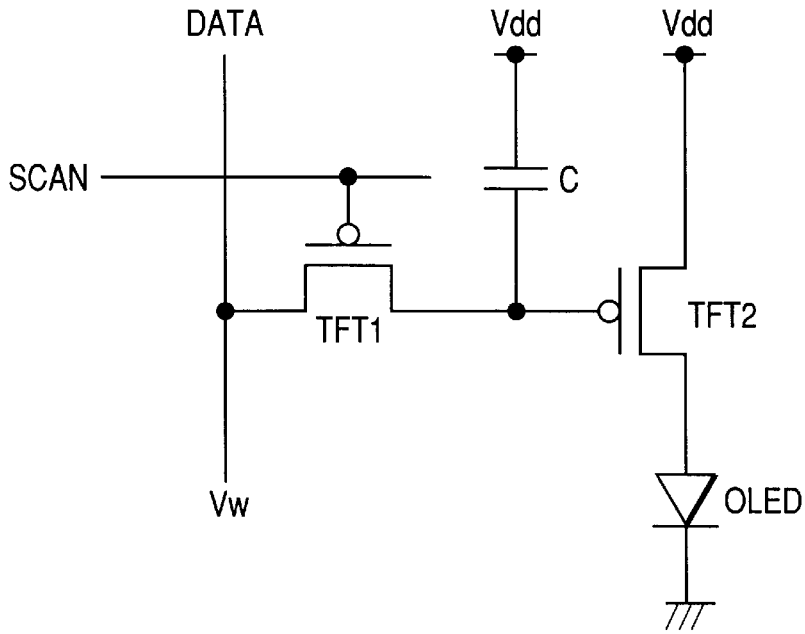
FIG. 9 is a diagram showing an active matrix display of Background Example 1.
Figure 10:
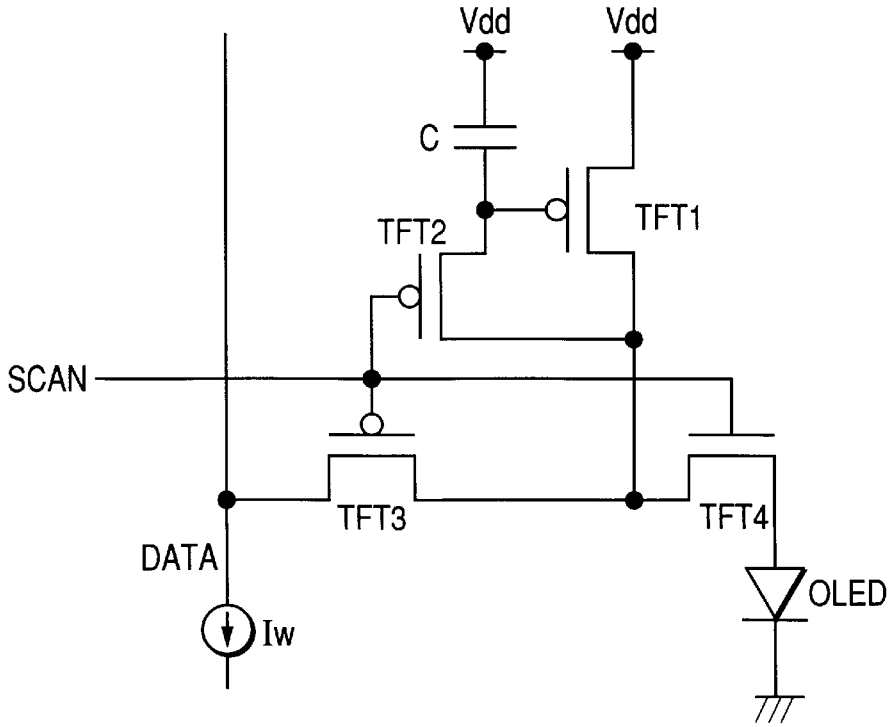
FIG. 10 is a diagram showing an active matrix display of Background Example 2.
Figure 11:
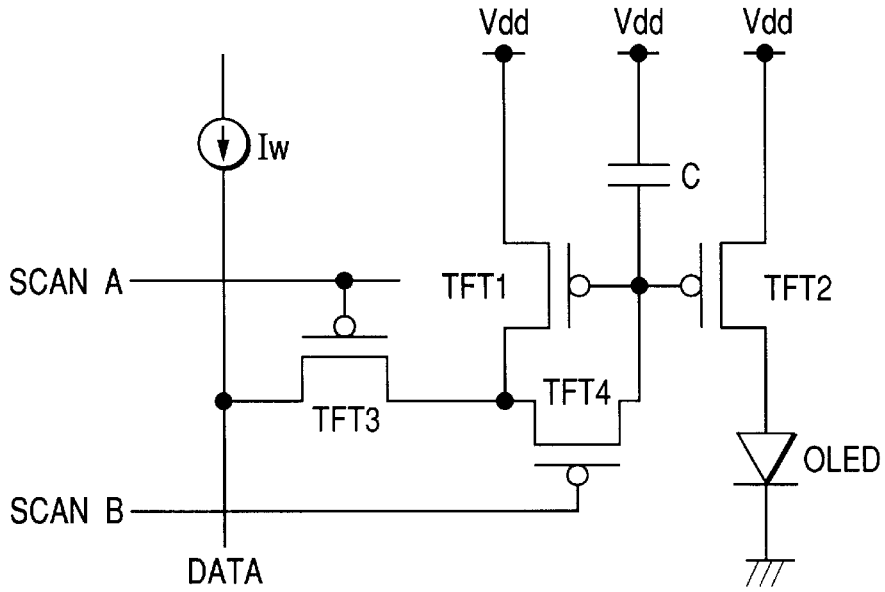
FIG. 11 is a diagram showing an active matrix display of Background Example 3.

FIG. 8 is a diagram showing a sixth embodiment of the active matrix display of the present invention. In FIG. 8, a pixel circuit is shown only for one pixel.

First, a structure of the active matrix display will be described. The inside structure of the pixel circuit will not be described because it is the same as that of the fourth embodiment.

A data side drive circuit is provided outside a pixel region. Inside the data side drive circuit, the reference current source Id having luminance information is connected to one end of the resistor R1 and is also connected to a negative electrode terminal of the voltage comparator AMP1. In addition, the monitor current Im correlating with a driving current is inputted in one end of the resistor R2 functioning as a monitor current-voltage converter and is also inputted in a positive electrode terminal of the voltage comparator AMP1. In addition, the other ends of the R1 and the R2 are connected to a ground potential. An output of the AMP1 is connected to a gate of the transistor T1 via the T2 functioning as a first switch circuit.

Next, parts characteristic of this embodiment among operations for setting and controlling a driving current will be described.

At the control time of a control voltage, the monitor current Im correlating with the driving current is inputted in the data side drive circuit. The monitor current Im controls the gate voltage (control voltage) of the transistor T1 via the T2 functioning as the first switch circuit such that a voltage Vm converted by the resistor R2 becomes equal to the voltage Vd generated by the reference current source Id and the resistor R1 and generates a driving current for realizing a desired luminance to supply it to a light emitting element.

The holding time of the control voltage will not be described because it is the same as that in the fourth embodiment.

In this embodiment, the same effect as in the fourth embodiment is obtained.

Seventh Embodiment

In this embodiment, the entire structure of the active matrix display including the structure described in each of the above-mentioned embodiments is shown. In particular, here, a description is made on the assumption that the active matrix display has the structure of the first embodiment. However, the active matrix display may be implemented in the same way if it has the structure of each of the second to sixth embodiments.

Figure 2:
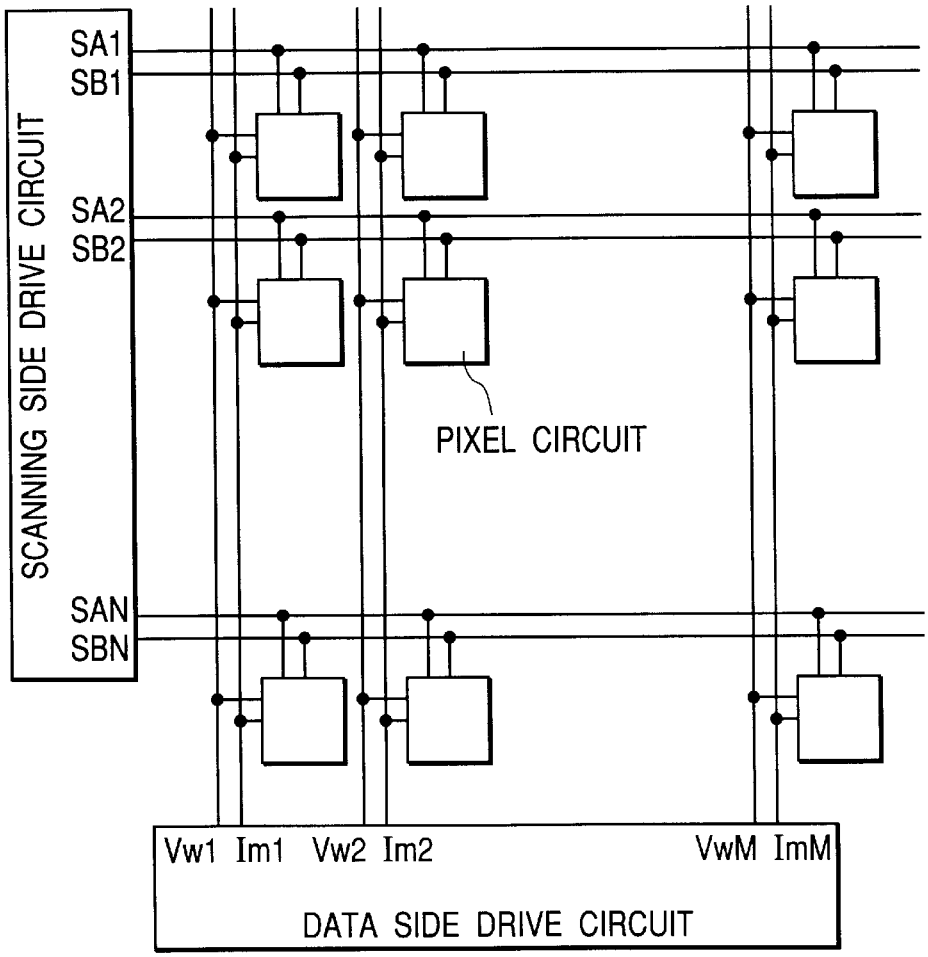
FIG. 2 is a diagram showing a seventh embodiment of the active matrix display of the present invention.
Figure 3:
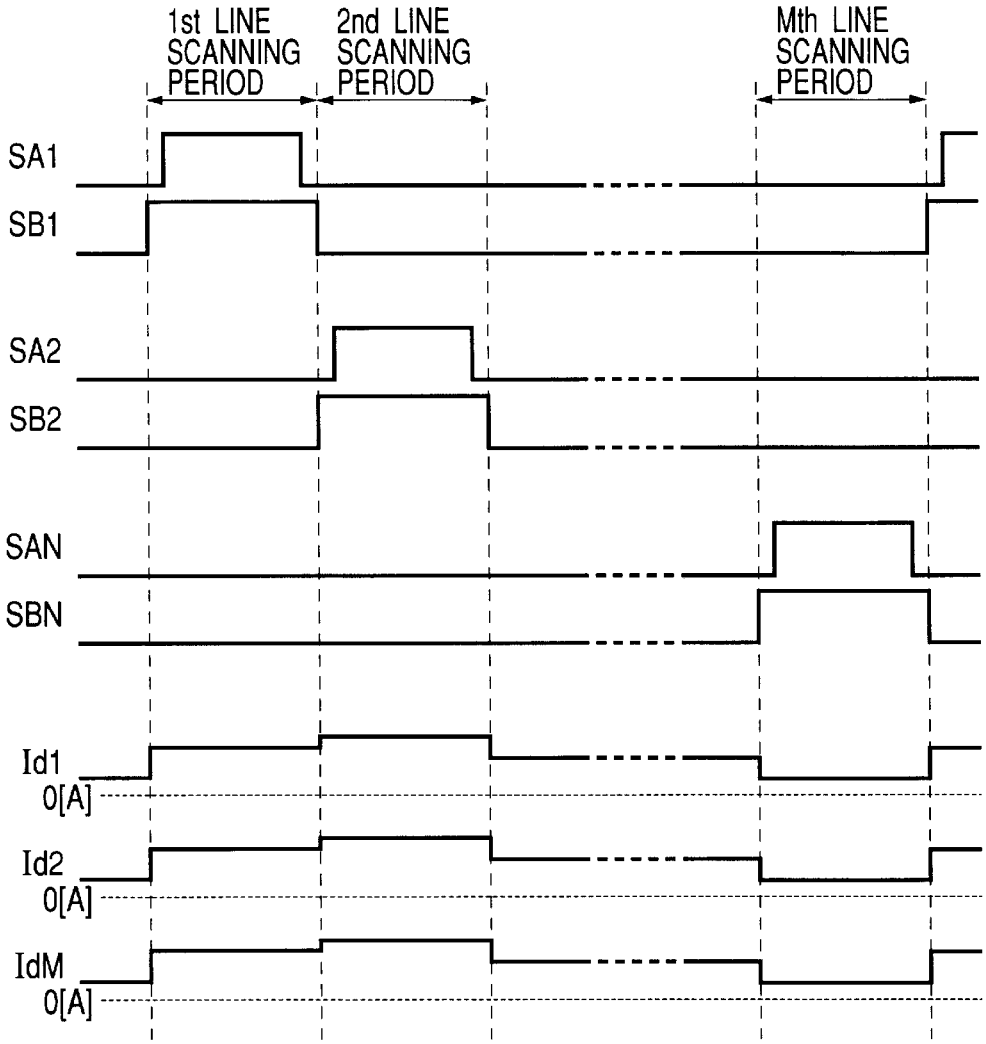
FIG. 3 is a timing chart of a scanning signal and a data signal in the structure of the seventh embodiment.

FIG. 2 is a diagram showing a seventh embodiment of the active matrix display of the present invention. FIG. 3 is a timing chart of a scanning signal and a data signal in a structure of this embodiment.

In FIG. 2, a part of the active matrix display having M×N pixels is shown. All Vw terminals of pixels aligned in a data line direction (in FIG. 2, pixels aligned in the vertical direction) are connected, and all Im terminals of the pixels are also connected in the same manner. The Vw terminals and the Im terminals are connected to a data side drive circuit provided outside a pixel region. In addition, all SA terminals and SB terminals of pixels aligned in a scanning line direction (in FIG. 2, pixels aligned in the horizontal direction) are connected to a scanning side drive circuit, respectively. Although not shown in the figure, since the scanning side drive circuit and the data side drive circuit are required to operate synchronously, the circuits exchange timing information. In addition, although not shown in the figure, luminance information sent from a system is inputted in the data side drive circuit.

Operations in this embodiment will be described.

When scanning of a first line is started, first, the scanning signal SB is set at a high level and, at the same time, a reference power source in the data side drive circuit sets a current value of the reference current source that is based on image information. Next, the scanning signal SA is set at the high level, and driving current setting control of each selected pixel is started.

The driving current setting control of the first line is finished in a regulated time, and control of a second line is performed. As the voltage control of the first line is finished, the scanning signal SA is set at a low level first and, subsequently, the scanning signal SB is set at the low level. At the same time, scanning of the second line is started. In the line for which the voltage control is finished, a driving current is supplied to a light emitting element based on a control voltage held in a capacitor in the pixel until the next scanning, and the light emitting element continues to emit light.

Further, although a form in which two scanning lines are used for one line is shown in the above description, the first and second switch circuits may be simultaneously turned on/off using only one scanning line. However, in order to accurately write the control voltage in the capacitor, timing of each control signal desirably has a relationship as shown in FIG. 3 explained in this embodiment.

A light emitting operation of each pixel will not be described here because it is shown in the first embodiment.

Eighth Embodiment

Figure 12:
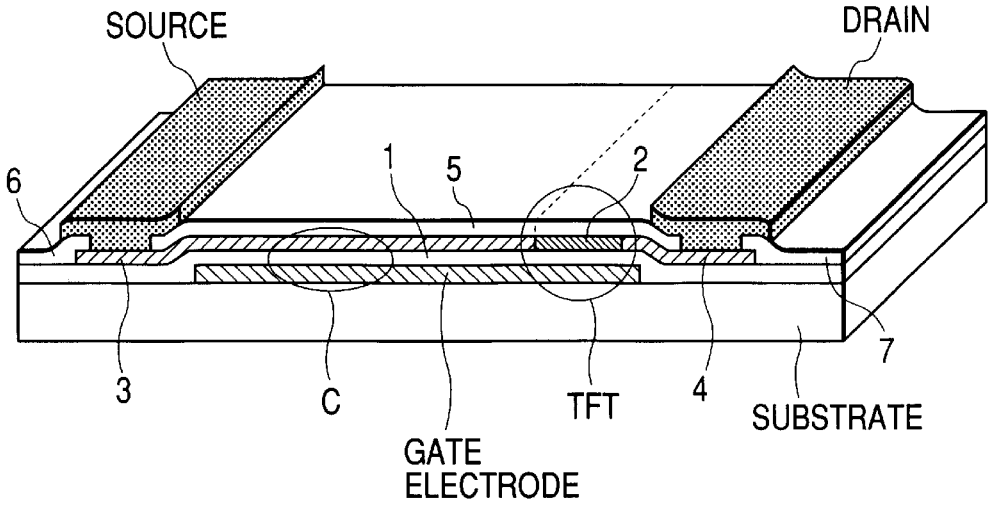
FIG. 12 is a sectional perspective view showing elements of an eighth embodiment of the active matrix display of the present invention.

FIG. 12 is a sectional perspective view showing elements of an eighth embodiment of the active matrix display of the present invention.

This embodiment is characteristic in that the active matrix display has the first voltage control current source constructed by the thin film transistor and the capacitor shown in the first to third embodiments, that is, a structure in which the source of the transistor T1 and one end of the capacitor C are connected to an identical potential.

A characteristic structure of the first voltage control current source will be described.

A gate electrode is formed on a substrate of glass or the like. On the gate electrode, a gate insulating film 1, a channel layer 2, and contact layers 3 and 4 consisting of a semiconductor thin film of amorphous silicon, polysilicon, or the like are formed. In order to realize a good contact between a source and a drain of a metal electrode, the contact layers 3 and 4 are set at a low resistance (p+ or n+) with impurities added. Moreover, insulating protective films 5, 6, and 7 are formed on the upper surfaces and the side surfaces of the channel layer 2 and the contact layers 3 and 4 consisting of a semiconductor thin film.

In the structure of the first voltage control current source of this embodiment, the contact layer on the source side and the gate electrode are overlapped such that a capacity sufficient for storing a control voltage can be secure in operation. Consequently, the transistor TFT and the capacitor C can be constituted integrally, and it is unnecessary to specially prepare a capacitor.

By using the first voltage control current source of this embodiment, it is unnecessary to form a transistor and a capacitor separately and thereafter connect them with metal wiring, whereby decrease of yield due to defective connection can be prevented and useless unevenness on a surface of a display after forming a pixel circuit can be reduced. Moreover, an area can be reduced.

As described above, if the present invention is used, a driving current can be supplied to a light emitting element steadily and accurately without being affected by variation of a threshold voltage of a transistor constituting a driving current source provided in each pixel.

In addition, a driving current is completely released from the influence of the Early effect. Moreover, even if an anode-cathode voltage of an OLED changes significantly by luminance or deterioration over time, a source/drain voltage of a transistor generating the driving current cannot be sufficiently secured, and an operation region changes to a triode region. Since the driving current can be supplied to a light emitting element steadily and at high accuracy, high definition image display is possible.

What is claimed is:

1. An active matrix display in which a plurality of pixels provided with a pixel circuit containing at least a light emitting element are arranged in a matrix shape and which has at least a scanning side drive circuit and a data side drive circuit for performing control of said pixel circuit, wherein said light emitting element is a light emitting element of a current control type, luminance of which changes according to a driving current flowing to the light emitting element, wherein said pixel circuit comprises at least said light emitting element, a first voltage control current source, a first switch circuit, a driving current-voltage converter, a second voltage control current source and a second switch circuit, said first voltage control current source comprising at least an active element controlled by a control voltage and a memory circuit capable of storing said control voltage and having a function of generating said driving current based on said control voltage, said first switch circuit having a function of switching said first voltage control current source to a voltage controllable state and a control voltage holding state, said driving current-voltage converter being serially connected to a current path through which said driving current flows and having a function of converting said driving current into a voltage, said second voltage control current source having a function of generating a monitor current correlating with said driving current based on an output voltage of said driving current-voltage converter, and said second switch circuit having a function of switching said second voltage control current source to an output state and a non-output state, wherein said scanning side drive circuit is at least connected to said first switch circuit and said second switch circuit and has a function of performing control for switching said first voltage control current source to the voltage controllable state or the control voltage holding state and control for switching said second voltage control current source to the output state or the non-output state, and wherein said data side drive circuit is at least connected to said first voltage control current source via said first switch circuit and connected to said second voltage control current source via said second switch circuit and has a function of controlling a control voltage of said first voltage control current source based on said monitor current correlating with said driving current such that a current value of said driving current becomes a desired current value corresponding to luminance information when said first voltage control current source is in the voltage controllable state and said second voltage control current source is in the output state.

2. An active matrix display according to claim 1, wherein said light emitting element, said first voltage control current source and said driving current-voltage converter are connected between a power supply potential and a ground potential in the order of said first voltage control current source, said light emitting element and said driving current-voltage converter or in the order of said driving current-voltage converter, said light emitting element and said first voltage control current source.

3. An active matrix display according to claim 1, wherein said light emitting element, said first voltage control current source and said driving current-voltage converter are connected between a power supply potential and a ground potential in the order of said driving current-voltage converter, said first voltage control current source and said light emitting element or in the order of said light emitting element, said first voltage control current source and said driving current-voltage converter.

4. An active matrix display according to claim 1, wherein said memory circuit of said first voltage control current source includes a capacitor, and said active element of said first voltage control current source, said second voltage control current source, said driving current-voltage converter, said first switch circuit and said second switch circuit are constructed by insulated-gate field-effect transistors.

5. An active matrix display according to claim 4, wherein said insulated-gate field-effect transistor is a thin film transistor.

6. An active matrix display according to claim 1, wherein said memory circuit of said first voltage control current source includes a capacitor, said active element of said first voltage control current source, said second voltage control current source, said driving current-voltage converter, said first switch circuit and said second switch circuit are constructed by insulated-gate field-effect transistors, and said insulated-gate field-effect transistor is a thin film transistor, and wherein said active element constituting said first voltage control current source includes a capacitor for causing a contact layer on a power supply side and a gate electrode to overlap each other to store a voltage.

7. An active matrix display according to claim 1, wherein said data side drive circuit includes at least a reference current source having luminance information, a reference voltage source and a voltage comparator for inputting an output end voltage of said reference current source having luminance information and a voltage of said reference voltage source, and has a function of inputting said monitor current in an output end of said reference current source having luminance information and controlling a control voltage of said first voltage control current source by said voltage comparator such that a current value of said monitor current and an output current value of said reference current source having luminance information become equal when said first voltage control current source is in the voltage controllable state and said second voltage control current source is in the output state.

8. An active matrix display according to claim 1, wherein said data side drive circuit includes at least a reference voltage source having luminance information, a monitor current-voltage converter for converting said monitor current into a voltage and a voltage comparator with a voltage of said reference voltage source having luminance information and an output voltage of said monitor current-voltage converter as inputs, and has a function of controlling a control voltage of said first voltage control current source by said voltage comparator such that a voltage of said reference voltage source having luminance information and an output voltage of said monitor current-voltage converter become equal when said first voltage control current source is in the voltage controllable state and said second voltage control current source is in the output state.

9. An active matrix display according to claim 1, wherein said data side drive circuit includes at least a reference voltage source, a monitor current-voltage converter for converting said monitor current into a voltage and a voltage comparator with a voltage of said reference voltage source and an output voltage of said monitor current-voltage converter as inputs, a conversion gain of said monitor current-voltage converter changing according to luminance information, and wherein said data side drive circuit has a function of controlling a control voltage of said first voltage control current source by said voltage comparator such that a voltage of said reference voltage source and an output voltage of said monitor current-voltage converter become equal when said first voltage control current source is in the voltage controllable state and said second voltage control current source is in the output state.

10. An active matrix display according to claim 1, wherein said data side drive circuit includes at least a monitor current-voltage converter for converting said monitor current into a voltage, a reference current source having luminance information, a reference current-voltage converter for converting an output current of said reference current source having luminance information into a voltage and a voltage comparator with an output voltage of said monitor current-voltage converter and an output voltage of said reference current-voltage converter as inputs, and has a function of controlling a control voltage of said first voltage control current source by said voltage comparator such that an output voltage of said monitor current-voltage converter and an output voltage of said reference current-voltage converter become equal when said first voltage control current source is in the voltage controllable state and said second voltage control current source is in the output state.

11. An active matrix display according to claim 1, said driving current-voltage converter and said second voltage control current source have a current mirror structure.

* * * * *